United States Patent [19]

Dickinson et al.

[11] Patent Number: 4,869,371

[45] Date of Patent: Sep. 26, 1989

[54] PUMP COMPONENTS FOR BUILDING PUMP, AND METHODS OF CONSTRUCTING AND USING SAME

[75] Inventors: William D. Dickinson; James Mirand, both of Medina, N.Y.

[73] Assignee: American Sigma, Inc., Middleport, N.Y.

[21] Appl. No.: 183,663

[22] Filed: Apr. 19, 1988

[51] Int. Cl.[4] ..... F04B 19/00

[52] U.S. Cl. ..... 206/577; 206/223; 417/238

[58] Field of Search ..... 206/223, 557, 577; 73/298, 863.71–863.73, 863.81–863.84, 864.16, 864.64; 417/238, 239, 360, 478, 546, 554

[56] References Cited

U.S. PATENT DOCUMENTS

| | | | |
|---|---|---|---|
| 1,372,031 | 3/1921 | McKissick | 417/238 |
| 1,447,992 | 3/1923 | Layne et al. | 206/223 |
| 1,603,675 | 10/1926 | Folsom et al. | 417/554 |
| 2,078,322 | 4/1937 | Gage | 417/238 |
| 2,180,864 | 11/1939 | Connor | 417/554 |
| 3,034,440 | 5/1962 | Hermanson | 417/238 |
| 3,113,522 | 12/1963 | Coberly | 417/238 |
| 4,076,467 | 2/1978 | Persson | 417/478 |
| 4,439,113 | 3/1984 | Owen | 417/478 |
| 4,603,735 | 8/1986 | Black | 417/172 |
| 4,621,987 | 11/1986 | Spingath | 417/554 |

FOREIGN PATENT DOCUMENTS

| | | | |
|---|---|---|---|
| 0489533 | 1/1930 | Fed. Rep. of Germany | 417/554 |

OTHER PUBLICATIONS

NWWA/EPA *Manual of Ground-Water Sampling Procedures,* Published in 1981, U.S. Department of the Interior Geological Survey Report.

*Downhole Pumps For Water Sampling in Small-Diameter Wells,* Published in 1979.

TIMCO Manufacturing Company, Catalog of Geotechnical, Ground Water Sampling Products, Published in Mar. 1982.

*Primary Examiner*—Jimmy G. Foster

*Attorney, Agent, or Firm*—Irving M. Weiner; Pamela S. Burt; Joseph P. Carrier

[57] ABSTRACT

The present invention discloses a groundwater sampling kit which comprises a plurality of components capable of being assembled into several alternative groundwater sampling devices by hand without the use of tools, the components being securely packaged in an impact-resistant carrying case.

21 Claims, 2 Drawing Sheets

PUMP COMPONENTS FOR BUILDING PUMP, AND METHODS OF CONSTRUCTING AND USING SAME

BACKGROUND OF THE INVENTION

1. Field of the Invention

The present invention pertains to a kit of components for constructing groundwater sampling devices. More particularly, the present invention pertains to a kit of components which can be used to construct several alternative groundwater sampling devices, depending on the needs and conditions encountered at a particular sampling site. For ease of transport, the kit is packed into a convenient impact-resistant carrying case.

2. Description of the Relevant Art

Bailers and gas drive pumps are known to those skilled in the groundwater sampling art. Bladder or air squeeze pumps are also known. Each of these devices is described in the NWWA/EPA *Manual of Ground-Water Sampling Procedures,* published in 1981.

Many times, a groundwater sampling professional cannot evaluate the best approach to use in obtaining a groundwater sample without a visit to the site in which the sample is to be taken. It is expensive and inconvenient to have to truck along every device that might be needed to sample groundwater.

Nowhere in the known art is there disclosed a portable kit of components which can be used to construct several alternative groundwater sampling devices, with the one to be constructed being determined after an on-site evaluation of all relevant parameters such as customer's desired outlay, constituent being tested for, well and topological conditions, access to the site, etc. Prior to the present invention it has been necessary either to make at least two trips out to the sampling site, to take a chance on the appropriateness of the sampling device chosen without an onsite analysis, or to transport numerous sampling devices at increased cost and inconvenience.

SUMMARY OF THE INVENTION

The present invention has been designed to overcome the above discussed disadvantages of the existing known groundwater sampling devices.

According to the present invention there is provided a groundwater sampling kit which comprises a plurality of components capable of being selectively assembled into several alternative groundwater sampling devices, the components being securely packaged in an impact-resistant carrying case. The components are capable of being assembled into the groundwater sampling devices by hand by a user without the use of tools. One selected group of the components is capable of being assembled into open top, bottom filling bailers of two lengths or into dual check valve bailers of two lengths. Another selected group of the components is capable of being assembled into gas drive pumps of two lengths, and a further selected group of the components is capable of being assembled into a bladder pump.

DETAILED DESCRIPTION OF THE PREFERRED EMBODIMENT

Figure 1:
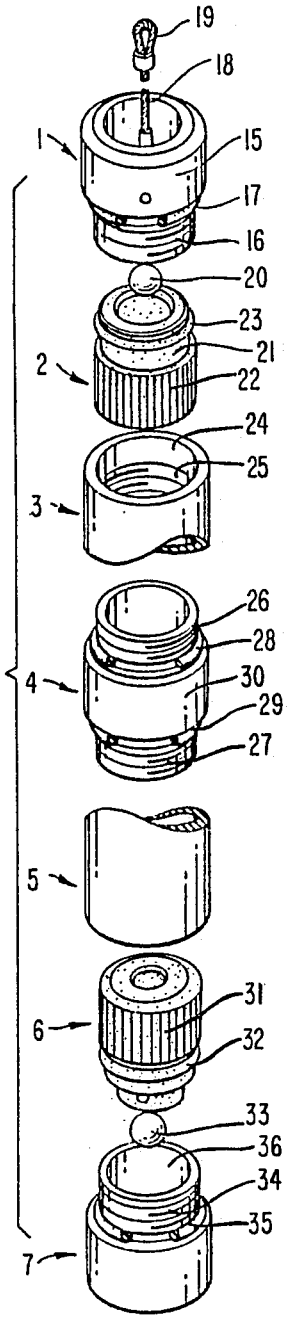
FIG. 1 shows the components of the present invention that would be used to construct a bailer.

Referring to FIG. 1, there is shown generally at 1 a bail adaptor including a hollow, cylindrical adaptor body or hand-grip portion 15 with a first threaded fastening portion 16 on the lower exterior thereof and a first sealing member 17 disposed in a groove on the outside of the adaptor body 15 above the first threaded portion 16.

The bail adaptor 1 has a support member 18 attached to the inside thereof for lowering the assembled bailer down a well, the attachment being made via a rod (not shown) which passes transversely through the adapter body 15 or other appropriate means. The support member 18 is looped over at the top end thereof and attached to itself to form an eyelet 19 for the fastening therethrough of means to lower the assembled bailer a further distance down a well, if necessary.

An upper check valve assembly is shown generally at 2, which if left out of the sequence of components shown in FIG. 1, would result in the remaining components of FIG. 1 being suitable and appropriate to be assembled into an open top, bottom filling bailer.

The upper check valve assembly 2 is generally a hollow cylinder having a constriction (not shown) on the inside lower portion thereof wherein upper check ball 20 fits sealingly. The outside lower portion of an upper check valve body 21 has a knurled surface 22 for gripping with the fingers in assembly. The upper check valve body 21 has a second sealing member 23 disposed in a groove above knurled surface 22.

The bail adaptor 1 and the upper check valve assembly 2 are dimensioned and shaped so that the upper check valve assembly 2 may be gripped by a user at the knurled portion 22 and sealingly inserted into the bottom of the bail adaptor 1, a seal being formed between second sealing member 23 and the inside wall of the bail adaptor 1.

Shown generally at 3 is a first pump body which may be a hollow hand-grippable cylinder substantially identical at both ends so that one end of pump body 3 is functionally interchangeable with the other, and thus only one end is shown. The first pump body 3 may be formed of stainless steel, PVC, or other suitable material. The inside wall of the first pump body 3 has at its upper part a smooth ring 24 and has a second threaded fastening portion 25 below the smooth ring 24.

The bail adaptor 1 and the first pump body 3 are dimensioned and shaped so that the first threaded portion 16 may be rotatably engaged with the second threaded portion 25 and tightened until first sealing member 17 sealingly engages with smooth ring 24.

The pump body coupler, generally shown at 4, is a hollow cylinder which may be formed from stainless steel, PVC, or other suitable material and has substantially identical functionally interchangeable third and fourth threaded fastening portions 26 and 27, respectively at the outside ends thereof. The third and fourth sealing members 28, 29 are disposed on grooves in the outside of the coupler body 30 adjacent the threaded portions 26, 27.

The pump body coupler 4 may be optionally used with second pump body 5 as pump length-extending components to form a longer assembled bailer when used than when omitted.

The second pump body 5 is substantially identical to the first pump body 3 except that the respective lengths may differ. The second pump body 5 also has upper and lower ends which are functionally interchangeable, each end having a smooth ring comparable to that shown at 24 on body 3 and a threaded fastening portion comparable to that shown at 25 on body 3. Therefore, when both the first pump body 3 and the second pump body 5 are to be used, each is rotatably engaged with the pump body coupler 4 until hand tight, at which condition the third and fourth sealing members 28, 29 will each be sealingly engaged with a smooth ring similar to that shown at 24.

If a shorter bailer is desired, the pump body coupler 4 and the second pump body 5 are both omitted, and the remaining parts will be assembled accordingly.

A lower check ball retainer is shown generally at 6, and is a hollow cylinder preferably formed from a plastic material. The upper outside face of the lower check ball retainer 6 has a knurled surface 31 for gripping with the fingers in assembly. The lower check ball retainer 6 has a fifth sealing member 32, preferably an O-ring, disposed in a groove in the outside thereof below the knurled surface 31.

The inside diameter of the lower check ball retainer 6 is smaller than the diameter of the lower check ball 33 so that it retains the lower check ball 33 from passing therethrough.

The lower check valve is shown generally at 7 and is a hollow hand-grippable cylinder which may be formed of stainless steel, plastic, or other suitable material, and has a constriction (not shown) on the inside lower portion thereof wherein lower check ball 33 fits sealingly.

The outer surface of the lower check valve 7 has a fifth threaded fastening portion 34 on the upper part thereof, and has a sixth sealing member 35 disposed in a groove thereon below the fifth threaded portion, and is sized to rotatably engage with the inner threaded portion of either the first pump body 3 or the second pump body 5 depending on the desired length of the finished bailer. In either case, when the lower check valve 7 is rotated until hand tight, the sixth sealing member 35 will sealingly engage with a smooth ring corresponding to 24 on the inside of the pump body. The lower check ball retainer 6 is dimensioned and shaped to fit sealingly inside the lower check valve 7 so that the fifth sealing member 32 sealingly engages with the smooth inner surface 36 of the lower check valve 7 and the lower edge of the knurled surface 31 meets the upper edge of the fifth threaded portion 34 of the lower check valve 7. Together, the lower check ball retainer 6, check ball 33 and check valve 7 define a check valve member.

Figure 2:
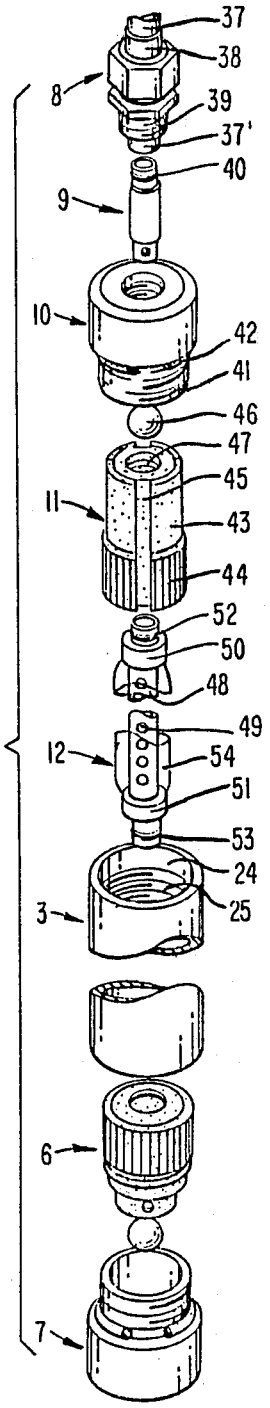
FIG. 2 shows the components of the present invention that would be used to construct a bladder pump.

Referring to FIG. 2, there is shown a series of components to be used in constructing a bladder pump. A compression fitting is shown generally at 8, having a coaxial construction in which water may pass through the center conduit 37, while air may pass through the space between the outside of the center conduit 37 and the outer conduit 38. Conduits 37 and 38 are preferably constructed of a plastic material which will not contaminate the groundwater being sampled, and center conduit 37 passes through the center of compression fitting 8 and can be seen extending therethrough at the bottom end thereof at 37' while outer conduit 38 is sealingly connected to compression fitting 8 in the standard fashion known to those skilled in the art. The outside bottom of compression fitting 8 has a sixth threaded fastening portion 39.

A barbed fitting is shown generally at 9 and comprises a hollow cylinder, preferably formed out of stainless steel or another noncorrosive metal. The upper outside surface of barbed fitting 9 has at least one barb 40 around the circumference thereof, and is sized to fit sealingly inside the bottom end 37' of the center conduit 37. The barb 40 has a downwardly directed sharp edge which functions to retain barbed fitting 9 inside center conduit 37 once inserted, and to form a watertight seal therein.

A top fitting is shown generally at 10, and comprises a hollow hand-grippable cylinder formed out of stainless steel, plastic, or a combination of the two. The lower exterior of the top fitting 10 has a seventh threaded fastening portion 41 thereon, and has a seventh sealing member 42 preferably an O-ring, disposed in a groove thereon above the seventh threaded portion 41. The top interior surface of the top fitting 10 is also threaded to define a fastening portion, and is sized so that the sixth threaded portion 39 of the compression fitting 8 may be rotatably engaged therewith.

A bladder pump check valve assembly is shown generally at 11, and comprises a hollow cylindrical check valve body 43 with a knurled portion 44 on the lower exterior thereof, for gripping with the fingers during assembly and disassembly, and vertical grooves like that shown at 45 formed into the outside surface thereof at 90 degree increments, for the passage of air therethrough when the bladder pump is in operation. The check valve body 43 has a constriction (not shown) on the inside lower portion thereof, wherein the check ball 46 fits sealingly.

The components are dimensioned and shaped so that the bladder pump check valve assembly 11 will fit inside the lower end of the top fitting 10 just until the top of the knurled surface 44 meets the bottom of the seventh threaded portion 41, and in addition the bottom of the barbed fitting 9 fits sealingly inside the top of the bladder pump check valve assembly 11, a seal being formed between the bottom outer smooth surface of the barbed fitting 9 and an eighth sealing member 47, preferably an O-ring, which is disposed in a groove near the inside top of the bladder pump check valve assembly 11. The barbed fitting 9 has a hole drilled transversely near the bottom thereof to allow for the passage of water therethrough if check ball 46 inadvertently blocks off the lower end thereof.

A bladder assembly is shown generally at 12 and comprises a hollow rod 48 with a plurality of transverse holes 49 drilled therethrough and two end caps 50, 51 on the respective ends thereof. The first and second end caps 50, 51 are hollow cylinders having ninth and tenth sealing members 52, 53, preferably O-rings, disposed in grooves on the respective outer ends thereof. Coaxial to the hollow rod 48 and sealingly attached to the end caps 50, 51 is a flexible bladder 54 comprised of teflon or other inert material. The components are sized so that the first end cap 50 fits sealingly inside the lower end of the bladder pump check valve assembly 11 with a seal being formed between the ninth sealing member 52 and the inner wall of the bladder pump check valve assembly 11.

Shown generally at 3 is the first pump body which is a hollow cylinder formed of stainless steel, plastic, or other inert material and is substantially identical at both ends so that one end of pump body 3 is functionally interchangeable with the other, as described hereinabove. Here first body 3 is shown cutaway because of its length, which may be made any appropriate length to fit in a well, but in any case will make up the majority of the length of the assembled pump. The bladder assembly 12 must be of a length to fit appropriately inside pump body 3. The present invention contemplates a bladder pump including a single pump body and a single bladder assembly 12 although one skilled in the art will realize that with an appropriate coupler used in conjunction with a pump body coupler 4 and a second pump body 5 it would be possible to make a kit having components capable of being assembled into a longer bladder pump. The inside wall of the first pump body 3 has at its upper part a smooth ring 24 and a second threaded portion 25 below the smooth ring 24 as described with reference to FIG. 1, which can be rotatably engaged with the seventh threaded portion 41 of the top fitting 10, and when thus rotated until hand tight, seventh sealing member 42 will sealingly engage with smooth ring 24.

A lower check ball retainer is shown generally at 6, and a lower check valve is shown generally at 7, these components being described hereinabove in the description of FIG. The components of the present invention are sized so that the second end cap 51 fits sealingly inside the top of the lower check ball retainer 6, and the lower check valve 7 rotatably engages with the first pump body 3 as hereinabove described.

Figure 3:
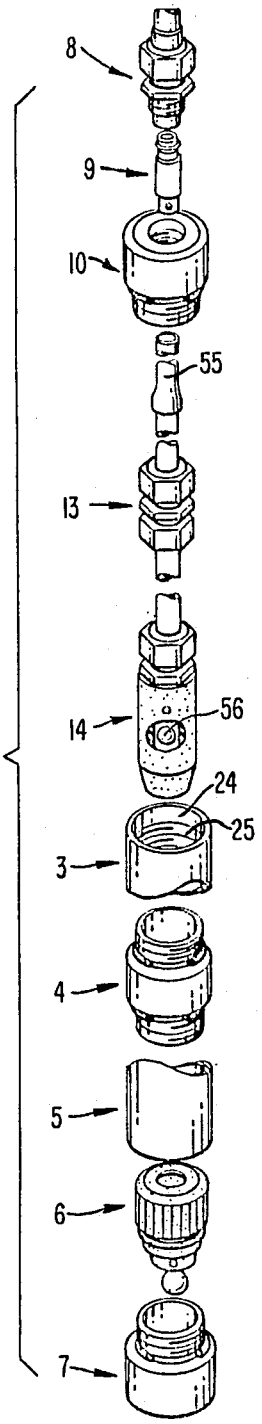
FIG. 3 shows the components of the present invention that would be used to construct a gas drive pump.

Referring to FIG. 3 there is shown a series of components to be used in constructing a gas drive pump. The compression fitting is shown generally at 8 and is the same compression fitting described hereinabove with reference to FIG. 2. In similar fashion, the barbed fitting 9 and the top fitting 10 are the same components described hereinabove with reference to FIG. 2.

Shown generally at 13 is a compression coupling which is only used in conjunction with the pump body coupler 4 and the second pump body 5 when a longer pump is desired. The compression coupling 13 will be recognized by those skilled in the art as a way to sealingly join two pieces of tubing together. Shown at the top of compression coupling 13 is a middle conduit 55 which is made of a deformable material to fit sealingly at its top end over the lower end of a barbed fitting 9 and to fit sealingly over either the conduit attached to compression fitting 13 or the conduit attached to the dip tube check valve assembly, shown generally at 14. The dip tube check ball 56 fits sealingly in a constriction (not shown) at the bottom of the inside of the hollow cylinder which comprises the dip tube check valve assembly 14 forming a part of the gas drive pump means.

The first pump body 3 may be rotatably engaged with the top fitting 10 as hereinabove described, forming a seal between seventh sealing member 42 and smooth ring 24. The pump body coupler 4 and the second pump body 5 may be optionally used when a longer pump is desired as hereinabove described in the discussion of FIG. 1.

The use of the lower check ball retainer 6 and the lower check valve 7 is required when assembling the gas drive pump shown in FIG. 3, but their function and installation is identical to that described hereinabove with reference to FIG. 1.

As will be understood from the foregoing, the groundwater sampling kit according to the invention includes a plurality of separate components adapted to be assembled in the field at a groundwater sampling site into a plurality of alternative groundwater sampling devices. To this end, the kit according to the invention includes: a first portion of components comprising a full complement of segments of a complete bladder pump having means to be connected together (FIG. 2); a second portion of kit components comprising a full complement of segments of a complete gas drive pump having means to be connected together (FIG. 3); and a third portion of kit components comprising a full complement of segments of a complete bailer pump having means to be connected together (FIG. 1). The components of the kit according to the invention includes at least one component (e.g., first pump body 3) which is common to at least two of the first, second and third portions of components and which constitutes a necessary segment in each of the pumps.

Figure 4:
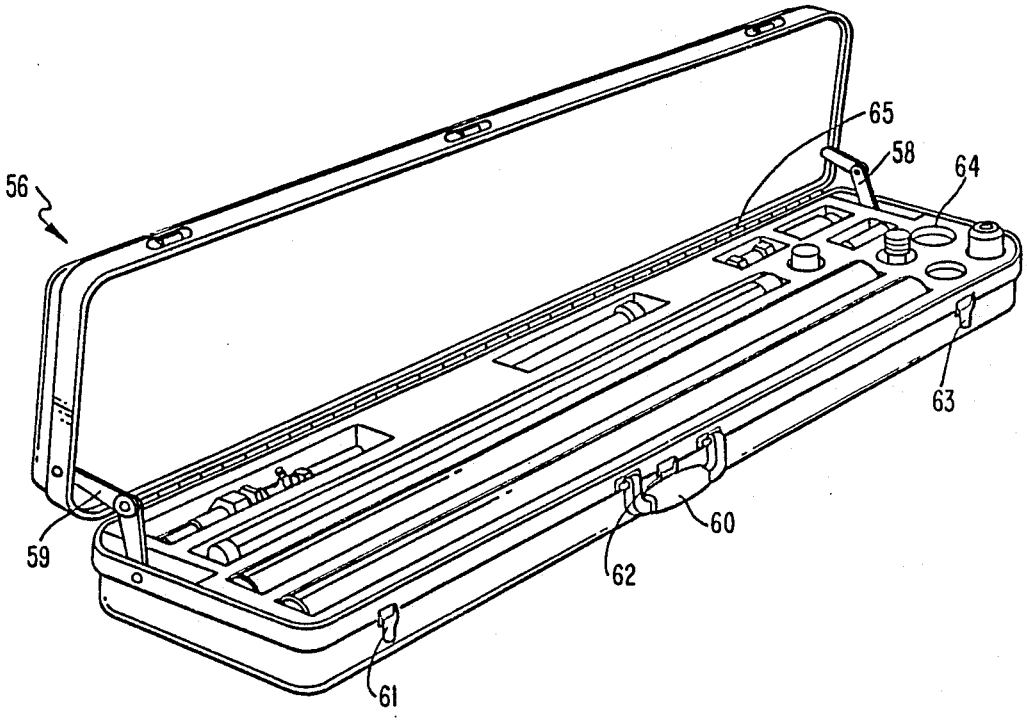
FIG. 4 is a perspective view of a preferred embodiment of the present invention, showing the case in an open position with the components securely packed therein.

Referring to FIG. 4, a carrying case is shown generally at 56, and includes a hinge 65, two locking supports 58, 59, handle 60 and clasps 61, 62, and 63. The components of the present invention may be seen securely packed into the spaces provided therefor in the resilient foam packing material 64. The case 56 is preferably made of an impact-resistant material.

Although there has been described what is at present considered to be the preferred embodiment of the present invention, it will be understood that the invention may be embodied in other specific forms without departing from the spirit or essential characteristics thereof.

The present description is therefore to be considered in all aspects as illustrative, and not restrictive. The scope of the invention is indicated by the appended claims rather than the foregoing description.

We claim:

1. A groundwater sampling kit having a plurality of separate components adapted to be assembled in the field at a groundwater sampling site into a plurality of alternative groundwater sampling devices, comprising:

a first portion of said plurality of components which comprises a full complement of segments of a complete bladder pump having means to be connected together;

a second portion of said plurality of components which comprises a full complement of segments of a complete gas drive pump having means to be connected together;

a third portion of said plurality of components which comprises a full complement of segments of a complete bailer pump having means to be connected together; and said components including at least one component which is common to at least two of said first, second and third portions such that said common component is adapted to constitute a necessary segment in each of said pumps.

2. A groundwater sampling kit according to claim 1, wherein:

said at least one common component comprises a first pump body having upper and lower end portions provided with said connecting means, and a check valve member;

said third portion includes a bail adaptor;

said connecting means of said bail adaptor is adapted to be interconnected with said connecting means of said upper end portion of said first pump body;

said connecting means of said check valve member is adapted to be interconnected with said connecting means of aid lower end portion of said first pump body; and said third portion of segments defines an open-top bottom-filling bailer pump.

3. A groundwater sampling kit according to claim 1, wherein:

said at least one common component comprises a first pump body having upper and lower end portions provided with said connecting means, and a check valve member;

said third portion includes a bail adaptor, and a check valve assembly adapted to be received in said bail adaptor;

said connecting means of said bail adaptor is adapted to be interconnected with said connecting means of said upper end portion of said first pump body;

said connecting means of said check valve member is adapted to be interconnected with said connecting means of said lower end portion of said first pump body; and said third portion of segments defines a dual check valve bailer pump.

4. A groundwater sampling kit according to claim 1, wherein:

said at least one common component comprises a first pump body having upper and lower end portions provided with said connecting means, a check valve member, a top fitting, a compressing fitting and a barbed fitting;

said connecting means of said top fitting is adapted to be interconnected with said connecting means of said upper end portion of said first pump body and to said compression fitting, said barbed fitting is adapted to be fitted in said compressing fitting, and said connecting means of said check valve member is adapted to be interconnected with said connecting means of said lower end portion of said first pump body; and said common components are adapted to constitute a necessary segment in said bladder pump an said gas drive pump.

5. A groundwater sampling kit according to claim 1, wherein:

said at least one common component comprises a first pump body having upper and lower end portions provided with said connecting means, and a check valve member.

6. A groundwater sampling kit according to claim 5, wherein:

said check valve member comprises a check valve provided with said connecting means, a check ball, and a check ball retainer adapted to be fitted in said check valve.

7. A groundwater sampling kit according to claim 5, wherein:

said first portion includes a bladder assembly adapted to be fitted in said first pump body; and said second portion includes gas drive pump means adapted to be fitted in said first pump body.

8. A groundwater sampling kit according to claim 5, wherein:

said components include pump length-extending components for selective use in extending the length of each of said pumps; and said pump length-extending components comprise a second pump body having upper and lower end portions provided with said connecting means, and a pump body coupler adapted to interconnect said first and second pump bodies.

9. A groundwater sampling kit according to claim 1, wherein:

said connecting means of a plurality of said components comprise threaded portions.

10. A groundwater sampling kit according to claim 1, further comprising:

a carrying case for holding said plurality of separate components.

11. A groundwater sampling kit having a plurality of separate components adapted to be assembled in the field at a groundwater sampling site into a plurality of alternative groundwater sampling devices, comprising:

a first portion of said plurality of components which comprises a full complement of segments of a complete bladder pump;

a second portion of said plurality of components which comprises a full complement of segments of a complete gas drive pump;

said components including a plurality of interchangeable components which are common to said first and second portions;

said plurality of interchangeable common components comprising a first pump body having upper and lower end portions, and at least one check valve member;

a plurality of said components of said first and second portions, and said common components, having connecting means for connecting said components together, said connecting means including a fastening portion adapted to mate with at least one other fastening portion and a hand-grip portion operatively cooperating with said fastening portion to permit said components to be assembled and disassembled without requiring tools; and each of said upper and lower end portions of said first pump body being provided with one of said fastening portions.

12. A groundwater sampling kit according to claim 11, further comprising:

a third portion of said plurality of components which comprises a full complement of segments of a complete bailer pump.

13. A groundwater sampling kit according to claim 12, wherein:

said third portion includes a bail adaptor having a fastening portion adapted to be interconnected with said fastening portion of said upper end portion of said first pump body;

said check valve member has a fastening portion adapted to be interconnected with said fastening portion of said lower end portion of said first pump body;

said third portion further includes a check valve assembly adapted to be selectively disposed in said bail adaptor; and said third portion of segments defines a dual check valve bailer when said check valve assembly is disposed in said bail adaptor, and said third portion alternatively defines an open-top bottom-filling bailer pump when said check valve assembly is not disposed in said bail adaptor.

14. A groundwater sampling kit according to claim 11, wherein:

said interchangeable common components further comprise a top fitting, a compression fitting and a barbed fitting;

said top fitting includes upper and lower fastening portions;

said lower fastening portion of said top fitting is adapted to be interconnected with said fastening portion of said upper end portion of said first pump body and said upper fastening portion of said top fitting is adapted to be interconnected with a fastening portion of said compression fitting; and said barbed fitting is adapted to be received in said compression fitting.

15. A groundwater sampling kit according to claim 11, wherein:

said fastening portions of said connecting means comprise threaded portions.

16. A groundwater sampling kit according to claim 11, wherein:

said first portion includes a bladder assembly adapted to be fitted in said first pump body; and said second portion includes gas drive pump means adapted to be fitted in said first pump body.

17. A groundwater sampling kit according to claim 11, further comprising:

a carrying case for holding said plurality of separate components.

18. A groundwater sampling kit according to claim 11, wherein:

said components inside pump length-extending components for selective use in extending the length of each of said pumps; and said pump length-extending components comprise a second pump body having upper and lower end portions provided with said fastening portions, and a pump body coupler having upper and lower end portions provided with said fastening portions and adapted to interconnect said first and second pump bodies.

19. A groundwater sampling kit having a plurality of separate components adapted to be assembled in the field at a groundwater sampling site into a plurality of alternative groundwater sampling devices, comprising:

a first portion of said plurality of components which comprises a full complement of segments of a complete bailer device;

a second portion of said plurality of components which comprises a full complement of segments of a complete gas drive pump;

said components including a plurality of interchangeable components which are common to said first and second portions;

said plurality of interchangeable common components comprising a first pump body having upper and lower end portions, and at least one check valve member;

a plurality of said components of said first and second portions, and said common components, having connecting means for connecting said components together, said connecting means including a fastening portion adapted to mate with at least one other fastening portion and a hand-grip portion operatively cooperating with said fastening portion to permit said components to be assembled and disassembled without requiring tools; and each of said upper and lower end portions of said first pump body being provided with one of said fastening portions.

20. A groundwater sampling kit according to claim 19, wherein:

said first portion includes a bail adaptor having a fastening portion adapted to be interconnected with said fastening portion of said upper end portion of said first pump body;

said check valve member has a fastening portion adapted to be interconnected with said fastening portion of said lower end portion of said first pump body;

said third portion further includes a check valve assembly adapted to be selectively disposed in said bail adaptor; and said third portion of segments defines a dual check valve bailer when said check valve assembly is disposed in said bail adaptor, and said third portion alternatively defines an open-top bottom-filling bailer pump when said check valve assembly is not disposed in said bail adaptor.

21. A groundwater sampling kit according to claim 19, wherein:

said components include pump length-extending components for selective use in extending the length of each of said pumps; and said pump length-extending components comprise a second pump body having upper and lower end portions provided with said fastening portions, and a pump body coupler having upper and lower end portions provided with said fastening portions and adapted to interconnect said first and second pump bodies.

* * * * *

UNITED STATES PATENT AND TRADEMARK OFFICE

CERTIFICATE OF CORRECTION

PATENT NO. : 4,869,371

DATED : September 26, 1989

INVENTOR(S) : Dickinson et al.

It is certified that error appears in the above-identified patent and that said Letters Patent is hereby corrected as shown below:

Column 1, line 39, change "onsite" to --on-site--.
Column 5, line 27, after "FIG." insert --1--.
Column 7, line 30 (Claim 4, line 6), change "compressing" to --compression--;
line 36 (Claim 4, line 12), change "compressing" to --compression--;
line 42 (Claim 4, line 18), change "an" to --and--.

Signed and Sealed this

Twenty-eighth Day of August, 1990

*Attest:*

HARRY F. MANBECK, JR.

*Attesting Officer*

*Commissioner of Patents and Trademarks*